United States Patent [19]

Mako

[11] 4,294,552

[45] Oct. 13, 1981

[54] BIDIRECTIONAL RIBBON DRIVE CONTROL FOR PRINTERS

[75] Inventor: John Mako, Endicott, N.Y.

[73] Assignee: International Business Machines Corporation, Armonk, N.Y.

[21] Appl. No.: 115,849

[22] Filed: Jan. 28, 1980

[51] Int. Cl.[3] ..... B41J 33/40

[52] U.S. Cl. ..... 400/219.1; 400/225; 400/234; 400/902; 101/336; 318/6

[58] Field of Search ..... 400/219, 219.1, 225, 400/234, 322, 323, 902, 903; 101/336; 242/203; 318/6, 7, 696

[56] References Cited

U.S. PATENT DOCUMENTS

| | | | |
|---|---|---|---|
| 3,730,082 | 5/1973 | Perry | 400/225 X |
| 3,902,585 | 9/1975 | Mogtader | 400/219.1 |
| 3,966,036 | 6/1976 | Bernardis et al. | 400/225 X |
| 4,000,804 | 1/1977 | Zaltieri | 400/234 X |
| 4,177,731 | 12/1979 | Kleist et al. | 400/219.1 X |

OTHER PUBLICATIONS

IBM Technical Disclosure Bulletin, "Use of Stepper Motor as Variable Load", Barnett, vol. 19, No. 11, Apr. 1977, pp. 4120–4121.

IBM Technical Disclosure Bulletin, "Stepper Motor Drive Circuit", Barcomb, vol. 20, No. 8, Jan. 1978, p. 3046.

*Primary Examiner*—Ernest T. Wright, Jr.

*Attorney, Agent, or Firm*—John S. Gasper

[57] ABSTRACT

A printer having an ink ribbon with a bidirectional ribbon drive in which a pair of stepper motors have their windings cross-coupled so that a drag current flows through one stepper motor to apply drag torque to the ribbon when the other stepper motor is operated for driving.

7 Claims, 2 Drawing Figures

BIDIRECTIONAL RIBBON DRIVE CONTROL FOR PRINTERS

DESCRIPTION

1. Technical Field

This invention relates to the control of ink ribbons in printers and, in particular, to a drive control for reversing the direction of the ribbon drive during a printing operation.

2. Background Art

In ribbon feeding for printers or the like it is known to provide a drive mechanism having two spools (one winding and one supply) each driven by an individual stepper motor. It is also known to use one motor to provide drag while the other drives the ribbon with the two motors switching rolls when the direction of the ribbon feeding is reversed. Such a ribbon feed is described in the article of J. A. Barnett, published in the April, 1977 issue of the IBM Technical Disclosure Bulletin, Vol. 19, number 11 at pages 4120–21.

In the control circuitry for the stepper motors a pedestal control and pedestal drivers are used for each motor. For the driving motor, the pedestal control turns on the pedestal driver which shunts a resistance in the drive motor winding circuits to provide a high current to the drive motor windings as they are toggled by phase control connected to phase drivers in the winding circuits. This high current provides the high torque for the drive motor. For drag torque the pedestal control turns off the pedestal drivers to reinsert the high resistance into the motor winding circuits. The current in the drag motor windings is thereby limited by the increase in the external resistance. It is also necessary for drag operation to turn on one or more of the phase drivers. To obtain a smooth drag torque, all of the phase drivers for the drag motor must be turned on. This prior art arrangement consequently involves costly switching arrangements and additional circuitry.

SUMMARY OF THE INVENTION

It is the purpose of this invention to provide control circuitry which is greatly simplified and requires less circuitry for operation and which will provide improved performance. Basically, this invention achieves this purpose by providing a drive/drag control circuit for dual stepper motors in which a cross coupling circuit arrangement is provided such that when one motor is energized to drive the ribbon the other is energized with a low level current to provide the necessary drag torque. Specifically, the coupling circuits comprise steering diodes connecting the windings of each motor through a current limiting resistor to the windings of the other motor. The diodes are connected in such a way that in the drive mode they isolate and clamp the phase drivers for the drive motor windings while in the drag mode they provide steering. Thus, when the drivers for the driver motor are toggled by the motor phase control by phase switching of the motor drivers, a low level drag current flows through the drag motor windings into the toggled windings of the drive motor. With this arrangement, the driver circuits for the drag motor remain off and drag current is uniform through all the windings of the drag motor. In this way, a uniform and balanced drag torque is obtained. Pedestal driver and control, along with other circuitry have been eliminated. Only the drive motor drivers need be operated. Consequently, the invention provides a drive/drag control for dual stepper motors for a bi-directional ribbon drive which is simpler, less costly, and more reliable in its operation.

The foregoing and other objects, features and advantages of the invention will be apparent from the following more particular description of preferred embodiments of the invention, as illustrated in the accompanying drawing.

BEST MODE FOR CARRYING OUT THE INVENTION

Figure 1:
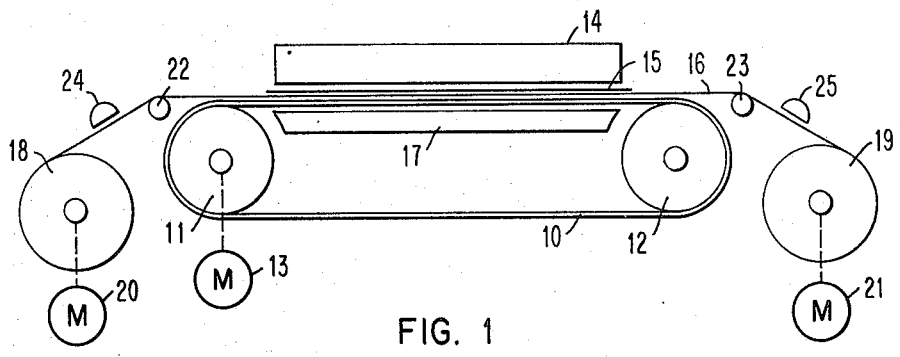
FIG. 1 is a schematic of a printer mechanism which incorporates a ribbon drive mechanism of the invention.

FIG. 1 shows a line printer mechanism that includes a type belt 10 formed in a loop and supported by pulleys 11 and 12. Motor 13 revolves the belt 10 at constant speed. A row of hammers 14 are selectively activated by controls not shown to impact paper 15 and ink ribbon 16 against engraved characters on the moving belt 10 to print characters in a line configuration. Platen 17 is located opposite the hammers 14 behind the belt 10. Paper 15 is moved in a vertical direction between print operations by a carriage drive mechanism. The ink ribbon 16 is fed in a horizontal direction during printing by a ribbon drive which includes spools 18 and 19 driven by left and right stepper motors 20 and 21. Guide posts 22 and 23 serve to support and maintain the vertical alignment of the ribbon 16. Detection devices, such as limit switches 24 and 25 located in the vicinity of the guide posts 22 and 23 respectively, sense when either end of the ribbon 16 has been reached and send signals used to actuate a motor drive control to automatically reverse the direction of feeding. Other types of detection devices which sense ribbon tension, diameter or motion change may also be used in place of limit switches 24 and 25.

In operation left stepper motor 20 drives spool 18 to feed ribbon 16 in the left direction while the right stepper motor 21 applies drag i.e. opposes but is overcome by the pull of the ribbon 16. In reversing direction, right stepper motor 21 becomes the drive motor and left stepper motor 20 becomes the drag motor.

Figure 2:
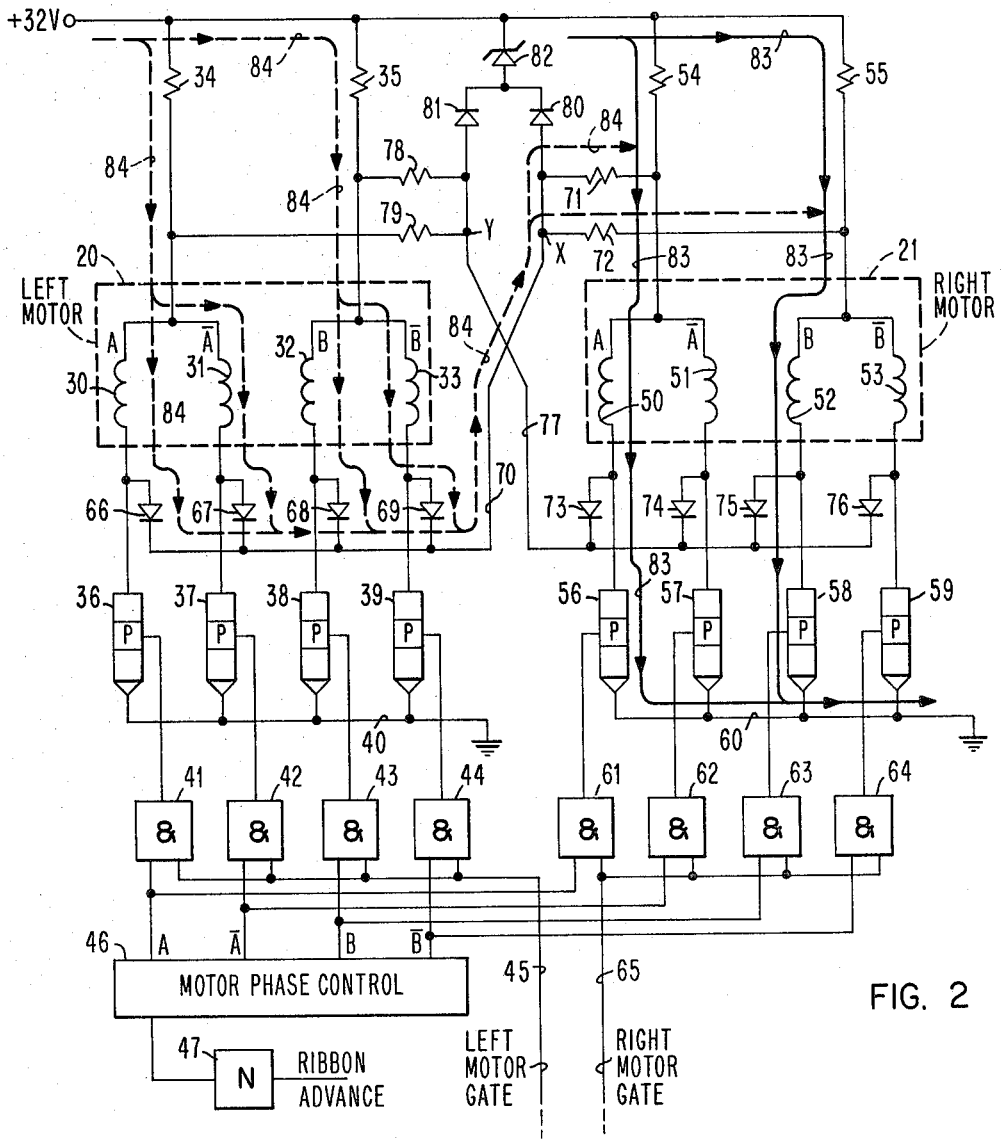
FIG. 2 is a detailed circuit diagram showing the stepper motor controls for the ribbon drive.

The control for operating the motors 20 and 21 to effect bidirectional reversible feeding of the ink ribbon 16 is shown in FIG. 2. In the preferred embodiment stepper motors 20 and 21 are identical dc operated four phase bi-filar-wound stepper motors having permanent magnet rotors. As seen in FIG. 2. The bi-filar windings 30 and 31 of left motor 20 have a common series connection through resistor 34 to a constant voltage source (+32 V). Bi-filar windings 32 and 33 of left stepper motor 20 have a common series connection through resistor 35 to the same voltage source. Motor drive transistors 36–39 are series connected from their collectors to the windings 30–33 as shown with the emitters attached to a common ground connection 40. Motor drive transistors 36–39 are individually base connected to the outputs of AND circuits 41–44. The first input to AND circuits 41–44 is a common connection 45 for receiving the directional signal LEFT MOTOR GATE which would come, for example, from limit switch 24. This signal would be up when left motor 20 is driving and down when right motor 21 is driving. The second inputs to AND circuits 41–44 are the individual connections A, $\overline{A}$, B and $\overline{B}$ from the motor phase control 46 which is driven to perform phase switching by RIBBON ADVANCE pulses applied through inverter 47 from an external source which could be a microprocessor (not shown).

Right stepper motor 21 has windings connected in an identical manner in a fully balanced network arrangement. Specifically, bi-filar windings 50 and 51 have a common series connection through resistor 54 to the constant voltage source (+32 V). Bi-filar windings 52 and 53 have their common connection in series with resistor 55 to the same constant voltage source. Motor drive transistors 56–59 are individually collector connected to the windings 50–53 as shown. Their emitters are attached to ground by a common connection 60. Motor drive transistors 56–59 are individually connected at the base to the outputs of AND circuits 61–64. The first input to AND circuits 61–64 is a common connection 65 for the directional signal RIGHT MOTOR GATE which would be supplied for example by limit switch 25. The second inputs to AND circuits 61–64 are the individual connections A, $\overline{A}$, B, $\overline{B}$ from the motor phase control 46.

The first cross coupling connection for the motors 20 and 21 comprises diodes 66–69 which are anode connected to the output side of windings 30–33 respectively of the left stepper motor 20 and cathode connected by lead 70 at node X with resistors 71 and 72 and to the common connections on the input sides of windings 50–53 of the right stepper motor 21.

The second cross-coupling connection comprises diodes 73–76 which are anode connected to the output side of the windings 50–53 of right stepper motor 21 and cathode connected through the common lead 77 at node Y with identical resistors 78, and 79 respectively and to the common inputs of windings 30–33 of the left stepper motor 20. The cross-coupling circuits are connected at nodes X and Y to the constant voltage source through isolating diodes 80 and 81 and zener diode 82.

Operation is as follows:

Assume right stepper motor 21 is the driving motor and left stepping motor 20 is the drag motor. The RIGHT MOTOR GATE signal is applied on line 65 to AND circuits 61–64. RIBBON ADVANCE pulses applied through inverter 47 activate the motor phase control 46 to phase switch the outputs A, $\overline{A}$, B, $\overline{B}$ through the AND circuits 61–64. This causes the motor drive transistors 56–59 to be turned on in a phasing sequence causing stepper motor 21 to rotate ribbon spool 19 in clockwise manner. Motor drive transistors 56–59 are turned on in sequence causing current to flow from the constant voltage source through resistors 54 and 55 through two windings such as 50, and 52 of right stepper motor 21. When driving, right stepper motor 21 steps in the conventional manner of a four-phase motor, for example, at a stepping rate of 160 steps per second. When drive transistor 56 is turned on, current flows through winding 50 as shown by the solid arrow 83. During this time left stepper motor 20 is energized to apply drag torque to ribbon spool 18. All four drive transistors 36–39 are turned OFF because LEFT MOTOR GATE is negative and AND circuits 41–44 block the phase signals from motor phase control 46. With the left motor drive transistors 36–39 turned OFF, a drag torque current flows through the left motor windings 30–33 along the path shown by the broken arrow 84. Since the right motor 21 is driving, node X is at a fairly smooth DC voltage which is slightly more negative than the supply voltage due to the voltage drop across resistors 54 and 55. Therefore, drag current can be pulled through the windings 30–33 of the left motor 20. The magnitude of drag current will determine the magnitude of the drag torque and is dependent on the cross-coupling resistors 71 and 72. Diodes 73–76 isolate drive transistors 56–59 such that normal stepping is not affected. Flyback voltage is clamped at 40 volts through diodes 80 and 81 and zener diode 82. Resistors 34, 35, 54 and 55 set the operating current defined by the needed torque.

When a "reverse" order is given, for example, by limit switch 24, advance of the right motor 21 is stopped. This is done by detenting, i.e. turning on two phases of the right motor 21. Simultaneously, two phases of the left motor 20 will be turned on, thereby stopping the ribbon 16 instantly and maintaining the ribbon 16 in a taut condition. After a fixed interval of time, for example, 100 milliseconds, the motors 20 and 21 change roles. Left motor 20 becomes the drive motor and right motor 21 becomes the drag motor. LEFT MOTOR GATE signal comes up gating motor phase signals from motor phase control 46 through AND circuits 41–44 to the motor drivers 36–39. RIGHT MOTOR GATE signal does down, low, thereby blocking the motor phase signals to the right stepper motor drive transistors 56–59. Drag current flows from the voltage source through resistors 54 and 55 and the windings 50–53 through diodes 73–76 to node Y and on through resistors 78 and 79 to the input of the left motor windings 30–33.

Thus, it will be seen that a drive drag motor control circuitry has been provided for an ink ribbon drive which is both simple and has a low number of circuit components. High reliability is obtained. Low power dissipation and cooler operation is also obtainable.

While the invention has been particularly shown and described with reference to a preferred embodiment thereof, it will be understood by those skilled in the art that the foregoing and other changes in form and details may be made therein without departing from the spirit and scope of the invention.

I claim:

1. A printer for printing characters on a print medium via an ink ribbon having a reversible ribbon drive for feeding said ribbon during printing comprising:

a pair of ribbon spools, first and second stepper motors connected separately to said spools, said first and second stepper motors each including windings for the operation thereof, control circuitry for operating said stepper motors such that when one stepper motor is driven, the other stepper motor is dragged, said control circuitry comprising a first set of motor drivers connected to said windings of said first stepper motor, a second set of drivers connected to said windings of said second stepper motor, means for applying phase sequencing signals to either said first or second set of drivers for driving only one of said stepper motors, and cross-coupling connections between said windings of said first and said second stepper motors forming a current path for drag current between said windings of one stepper motor when the other stepper motor is driving.

2. A printer in accordance with claim 1 in which said cross coupling connections include unidirectional current means for steering the direction of flow of said drag current.

3. A printer in accordance with claim 2 in which said cross coupling connections further includes resistor means connected in series with said unidirectional current means for limiting the magnitude of said drag current to provide a predetermined drag torque produced by said drag current.

4. A printer in accordance with claim 3 in which said unidirectional current means comprise diodes connected between the output side of the motor windings of one stepper motor to the input side of the motor windings of the other stepper motor.

5. A printer in accordance with claim 3 in which said unidirectional current means comprises individual diodes connecting to the output of individual motor windings of said stepper motors to said resistor means.

6. A printer in accordance with claim 4 in which said means for applying phase sequencing signals to either said first or said second set of drivers includes AND circuits connected to said first and second set of drivers, a source of phase sequence signals connected to said AND circuits and means for supplying directional signals to said AND circuits for gating said phase sequence signals to the AND circuits for either said first or second set of stepper motor drivers.

7. A printer in accordance with claim 6 in which said source of phase sequence signals further includes a motor phase control means for receiving ribbon advance pulses.

* * * * *